United States Patent [19]

Maloof

[11] Patent Number: 4,478,144

[45] Date of Patent: Oct. 23, 1984

[54] CAP PRINTING SYSTEM

[76] Inventor: Ferris A. Maloof, P.O. Box 778, McCaysville, Ga. 30555

[21] Appl. No.: 205,695

[22] Filed: Nov. 10, 1980

Related U.S. Application Data

[63] Continuation-in-part of Ser. No. 030,635, Apr. 16, 1979, Pat. No. 4,266,476.

[51] Int. Cl.[3] ..... B05C 17/06

[52] U.S. Cl. ..... 101/126; 101/127

[58] Field of Search ..... 101/35–40, 101/123, 126, 127.1, 124

[56] References Cited

U.S. PATENT DOCUMENTS

| | | | |
|---|---|---|---|
| 1,252,043 | 1/1918 | Shourt | 101/40 X |
| 2,105,572 | 1/1938 | Williams | 101/124 |
| 2,347,022 | 4/1944 | Austin | 101/127.1 X |
| 2,818,803 | 1/1958 | Levorson | 101/127.1 |

*Primary Examiner*—A. J. Heinz

*Attorney, Agent, or Firm*—Louis T. Isaf

[57] ABSTRACT

An improved cap printing sytem for silk screen printing on the soft, curved surfaces of baseball caps and the like, comprises a method of printing which includes the steps of forcing both the soft fabric of the cap and the printing screen to take cooperating curvatures which cooperate to facilitate silk screen printing on the soft fabric, pre-curved panels of the caps. Furthermore, the present system comprises a method and apparatus providing for the flat storage of reusable silk screening screens which are forced into curved configurations for printing on curved surfaces.

3 Claims, 4 Drawing Figures

CAP PRINTING SYSTEM

CONTINUATION IN PART

This application is a continuation-in-part of application, Ser. No. 30,635, filed Apr. 16, 1979, now U.S. Pat. No. 4,266,476 the filing date of which is hereby claimed for the common subject matter under 35 USC 120.

FIELD OF THE INVENTION

The present invention relates generally to the field of silk screen printing, and more specifically to improvements in apparatus used for silk screening on curved surfaces of baseball caps and the like.

BACKGROUND OF THE INVENTION

Prior to the present invention, I invented a certain printing apparatus described in U.S. patent application Ser. No. 30,635, filed June 16, 1980, the specification of which is hereby incorporated herein by reference and made a part hereof as if recited herein in full. The previous apparatus comprised, generally a curved printing platform, a curved screen frame including a system for attaching a printing screen to the screen frame, and a cap clamping and stretching assembly. Since the introduction of the apparatus of the previous application certain improvements have been made to the apparatus.

SUMMARY OF THE INVENTION

Briefly described, the present invention comprises an improved cap printing apparatus including an improved screen frame assembly. The screen frame assembly of the present invention includes a screen clamping assembly comprising rigid plates or clamp members releasably drawn against the screen frame body. These plates clamp the printing screen tightly in place on the screen frame assembly. The improved apparatus of the present invention further includes a printing screen assembly comprising a border onto which a printing screen is mounted. The border is flexible such that it maintains the printing screen in a flat state for easy storage when removed from the screen frame assembly and allows the screen to be shaped in a curve for easy mounting on the screen frame.

Therefore, it is an object of the present invention to provide an improved cap printing apparatus and method for silk screen printing on curved surfaces.

Another object of the present invention is to provide an improved cap printing apparatus including an improved system for mounting, removing and storing printing screens in a cap printing apparatus.

Other objects, features and advantages of the present invention will become apparant upon reading the following specification, when taken in conjunction with the accompanying drawings.

DETAILED DESCRIPTION OF THE DRAWINGS

Figure 1:
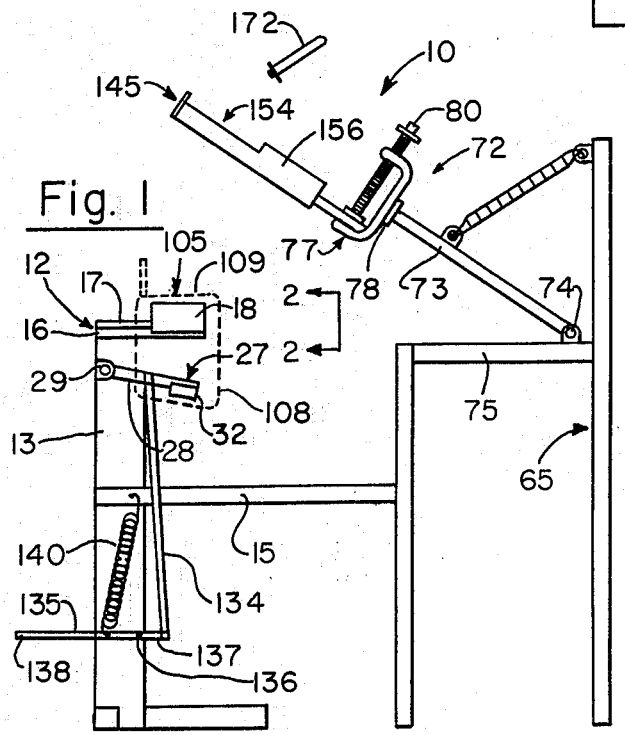
FIG. 1 is a side view of the cap printing apparatus of the present invention.

Referring now in greater detail to the drawings in which like numerals represent like components throughout the several views, FIG. 1 depicts the cap printing apparatus 10 of the present invention. The cap printing apparatus 10 comprises a support structure 65 and an arm assembly 72 mounted on the support structure 65. The arm assembly 72 includes a rectilinear shaft or arm 73 attached at a pin 74 to the upper plate 75 of the support structure 65. A frame-clamp assembly 77 is mounted at the free end of the shaft 73 and includes a horizontal bar 78, to which are attached screw clamps 80.

Figure 2:
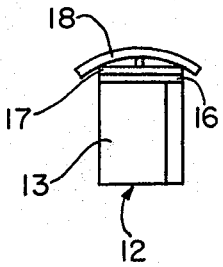
FIG. 2 is an isolated view of the platform assembly of the present invention, the view being taken along line 2—2 of FIG. 1.

A platform assembly 12 is positioned adjacent the support structure 65 and is supported atop a platform stand 13. A rigid spacer bar 15 connects the platform stand 13 to the support structure 65. The platform assembly 12 includes a lower plate 16 and an upper plate 17 on top of the lower plate. A curved printing platform 18 is mounted on top of the upper plate 17 and is curved concave downward. (see also FIG. 2). The printing platform 18 is formed in a curvature which is preferably predetermined by the user to be a curvature at which printing on curved surfaces using the curved silk screen of this invention, can be satisfactorily accomplished. The upper plate 17 is movably attached to the lower plate 16 in order that adjustments in the position of the platform 18 can be made.

A hat clamp assembly 27 is mounted to the platform stand 13 below the lower plate 16 of the platform assembly 12. The hat clamp assembly 27 includes a clamp plate 28 attached at pin 29 to the stand 13, and a curved cap engaging portion 32. The cap engaging portion 32 is curved concave upward. A bar 134 is attached to the bottom of the clamp plate 29 and extends to a foot plate 135. The foot plate 135 pivots about a pin 136 which pin is positioned between the ends 137, 138 of the foot plate. The bar 134 is attached at one end 137 of the foot plate. A spring 140 is connected from the platform stand 13 to the foot plate 135 at a point on the foot plate on the opposite side of pin 136 from the bar 134.

Figure 3:
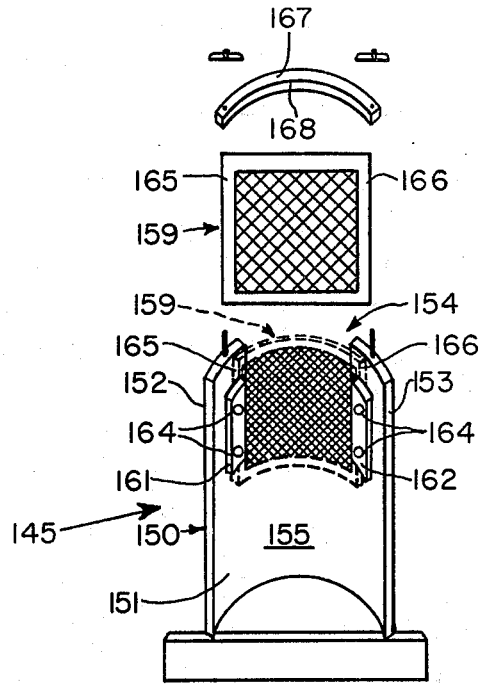
FIG. 3 is an exploded bottom view of the screen frame assembly of the present invention, including a phantom view of the printing screen member mounted in the frame member.

Removably clamped to the screw clamps 80 of the frame clamp assembly 77 is a screen frame assembly 145. As seen in FIG. 3, the screen frame assembly 145 includes a frame member 150 which has a curved major body portion 151 and two fingers or extentions 152, 153. The frame member 150, including the body 151 and extensions 152, 153, defines a curvature which is preferably predetermined by the user to be a curvature at which the printing screen 171 can cooperate satisfactorily with the curved printing platform 18 to effectively print on the curved surfaces of a cap. Although the platform curvature and frame member curvature are cooperating, they are not necessarily equal. The frame member 150 has a bottom side 155, being that side view in FIG. 3, and a top side 156 being that side viewed in FIG. 1. The extensions 152, 153 extend parallel to one another from the body portions 151 and define an open space 154 between them. A printing screen member 159 is positioned against the bottom side 155 of the frame member 150 and spanning the open space 154. A first screen holding bar 161 is drawn by bolts 164 over one edge 165 of the printing screen member 159 at the extension 152 to pinch the screen member between the bar 161 and extension 152. A second screen holding bar 162 is drawn by bolts 164 over an edge 166 of the printing screen member 159 at the extension 153 to pinch the screen member between the bar 162 and extension 153.

Figure 4:
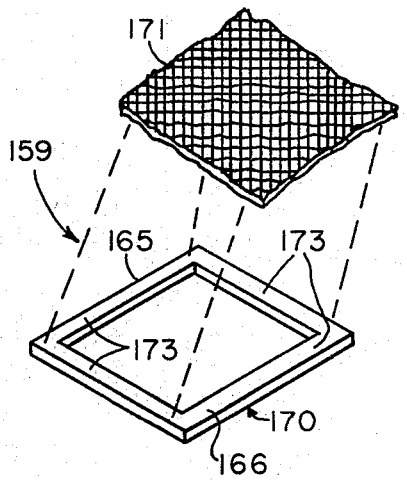
FIG. 4 is a pictorial view of an isolated printing screen member in accordance with the present invention.

The printing screen member 159, as shown in FIG. 4, includes a rectangular boarder 170, which is comprised of resilient material. The boarder 170 includes four flat side members 173 joined together in a rectangle defining a flat plane among them. The side members 173 are resilient in nature such that if they are bent or bowed they will spring back to their normal flat state. Thus a resilient boarder 170 is provided which will be biased to a configuration defining a flat plane. In the preferred embodiment, the resilient side members 173 comprise spring steel. A silk screening screen 171 comprised of meshed material typical in the art (i.e. nylon, silk, polyesters, etc.) is stretched tightly across the boarder 170 and glued or otherwise attached onto the boarder 170. The silk screening printing screen 171 used preferably in the present invention is a conventional silk screening screen prepared in the typical manner of attaching typical silk screening material (i.e. nylon, silk, polyester, etc.) to a flat frame, coating the material with a light sensitive emulsion, and exposing the flat, coated screen in a darkroom to light transmitted through a positive of the design. In the present invention, the sheet material is stretched onto the resilient boarder 170 which serves as the flat frame of the previous sentence and the silk screening screen is prepared with a design while already attached to the resilient boarder. The screen member 159 with the prepared screen 171 already attached is, therefore, ready to be mounted to the frame member 150. The conventional silk screening printing screen 171 known in the art, and preferably used in this invention, comprises a flat but not rigid sheet of meshed material such as nylon, silk, polyester or steel wire treated as above. The typical silk screening screen is flexible in that it can be bent or twisted without damage. Generally, the typical screen is also nonmalleable in that it will not retain the shape to which it is bent or twisted.

While mounting the screen member 159 on the frame member 150 across the open space 154, the normally flat, resilient boarder 170, with the screen 171 attached, is bowed by pushing the two opposing edges 165, 166 toward one another. The bowed screen member 159 is inserted between the frame member extensions 152, 153 and their respective holding bars 161, 162. The holding bars 161, 162 are then drawn toward the extensions 152, 153 by bolts 164 to hold the screen member tightly in its bowed state. Adjustments can be made to align the curvature of the bowed screen member 159 with the curvature of the frame member 150, if desired. A third holding bar (not shown) in alternative embodiments, is located at the end of the open space on the body portion 151. This third holding bar is shaped to the curvature of the frame member 150 and, when drawn against the boarder 170 of the screen member 159, the third bar forces at least one end of the screen member to conform to the curvature of the frame member. An end piece 167, curved to match the curvature of the frame member 150, is removably bolted to the outer ends of the extensions 152, 153. Preferably, the boarder 170 of the screen member 159 abuts the bottom edge 168 of the end piece 167. That is, the boarder 170 extends slightly beyond the extensions 152, 153.

OPERATION

In operation, the resilient printing screen member 159 is assembled in its flat state prior to mounting on the screen frame assembly 145. Once assembled, the printing screen member 159 is bowed and mounted on the screen frame assembly 145 as earlier described. The screen frame assembly 145 is mounted on the arm 73 of the support structure 65. The screen frame assembly 145 is removeably held to the arm 73 by screw clamps 80.

A cap or like object 105 is placed on the platform assembly 12 with a surface 109 of the cap which is to be printed presented for printing supported on top of the curved printing platform 18. The object 105 which is preferably printed by the present invention is a precurved, soft fabric baseball cap 105. The silk screen printing is to be accomplished on the soft outer surface of the curved panels 109 of the cap 105. The cap 105 is positioned with the clamp plate 28 of the hat clamp assembly 77 inserted inside the hat portion 108 of the cap. The clamp plate 28, as a result of the force of spring 140, pushes down on the lower hat portion 108 which pulls the upper panels 109 of the cap against the platform 18. The action causes the cap surface 109 which is to be printed to take a curvature which conforms to the curvature of the platform 18.

The screen frame assembly 145 is lowered into a printing position by pivoting the arm 73 downward about pin 74 to bring the printing screen 171 to a location just above, and in near contact with, the cap surface 109. Printing ink is poured into the open space 154 on the top of the screen 171, after which the ink is worked through the screen using a squeegy or other ink spreading device 172 to transfer the ink to the cap surface 109.

Once the ink transfer, or printing, has been completed, the screen frame assembly 145 is returned to a non-printing position by pivoting the arm 73 upward. The screen holding bars 161, 162 are loosened and the printing screen member 159 is removed from the frame member 150. Once removed, the resilient boarder 170 causes the screen member 159, and thus the screen 171 to spring back to a flat configuration for ease of storage or for removal of print design and reuse of the screen while still attached to the boarder 170.

Whereas this invention has been described in detail with particular reference to preferred embodiments thereof, it will be understood that variations and modifications can be effected within the spirit and scope of the invention as described hereinbefore and as defined in the appended claims.

I claim:

1. An improved apparatus for silk screen printing on curved flexible panels of baseball caps and like curved flexible objects, said apparatus comprising:

a curved printing platform for supporting a panel of a cap thereon, said platform defining a predetermined curvature;

movable cap shaping means associated with said platform for causing a flexible panel of a cap supported by said platform to take a curvature conforming to said curvature of said platform;

a flexible silk screening printing screen;

resilient means for biasing said printing screen to take a flat configuration;

means for transferring ink through said printing screen to said flexible panel supported on said printing platform; and screen shaping means for overcoming the bias of said resilient means and for temporarily causing said silk screening printing screen to take a curved configuration defining a curvature which cooperates with the curvature of said platform to enhance the transfer of ink to the panel.

2. A method of silk screen printing on curved flexible panels of baseball caps and like curved flexible objects, said method comprising the steps of:

stretching silk screening material across a resilient, normally flat border;

attaching the screening material to the resilient border to form an integrated, resilient, normally flat screen member;

preparing the screening material with a design while the material is attached to the flat border;

determining a curvature suited to printing on a curved surface;

forming a curved platform which comprises the determined curvature;

supporting a curved flexible panel of a cap on the platform;

causing the curved flexible panel on the platform to take a curvature conforming to the platform curvature;

causing the integrated screen member to take a curved configuration defining a curvature which cooperates with the curvature of the platform;

holding the curved screen member over the panel on the platform;

transferring ink through the curved printing screen of the screen member to the flexible panel; and returning the resilient screen member to its normally flat state.

3. Method of claim 2, further comprising the steps of:

removing the design from the screening material attached to the border; and preparing the screening material with a new design while the material is still attached.

* * * * *